United States Patent [19]

Fogarty et al.

[11] Patent Number: 4,575,078

[45] Date of Patent: Mar. 11, 1986

[54] POOL GAME SET

[76] Inventors: A. Edward Fogarty; Bonnie R. Fogarty, both of 3513 School Ave., Sarasota, Fla. 33579

[21] Appl. No.: 627,926

[22] Filed: Jul. 5, 1984

[51] Int. Cl.[4] ..... A63G 31/00

[52] U.S. Cl. ..... 273/9; 273/5 A; 273/8; 273/12; 273/123 R

[58] Field of Search ..... 273/2, 4 C, 5 R, 5 A, 273/5 C, 8, 9, 14, 4 A, 4 B, 59, 87, 87.2, 87.4, 12, 70, 177 A, 123 R

[56] References Cited

U.S. PATENT DOCUMENTS

| | | | |
|---|---|---|---|
| 83,759 | 11/1868 | Buzby | 273/2 |
| 86,479 | 2/1869 | White | 273/9 |
| 278,934 | 5/1883 | Gleason | 273/70 |
| 488,743 | 12/1892 | Scott et al. | 273/9 |
| 704,892 | 7/1902 | Lowerre | 273/4 R |
| 747,716 | 12/1903 | How | 273/2 |
| 1,006,516 | 10/1911 | Weston | 273/113 |
| 1,092,006 | 3/1914 | Bailey | 273/3 R |
| 1,478,046 | 12/1923 | Miller | 273/9 |
| 1,543,133 | 6/1925 | Tilley | 273/9 |
| 1,570,422 | 2/1926 | Adams | 273/87.2 |
| 1,661,966 | 3/1928 | Ruziska et al. | 273/70 |
| 1,667,101 | 4/1928 | Christoph | 273/12 |
| 2,014,778 | 9/1935 | Strickler et al. | 273/2 |
| 2,224,730 | 12/1940 | Hess | 273/127 R |
| 2,540,729 | 2/1951 | Haskell | 273/5 A |
| 2,836,422 | 5/1958 | Borah | 273/127 R |
| 3,428,322 | 2/1969 | Motz | 273/123 R |
| 3,464,697 | 9/1969 | Robillard, Jr. | 273/127 R |
| 3,591,176 | 7/1971 | Roth | 273/6 |
| 4,240,634 | 12/1980 | Wiczer | 273/127 R |

FOREIGN PATENT DOCUMENTS

| | | | |
|---|---|---|---|
| 922287 | 3/1963 | United Kingdom | 273/177 A |

*Primary Examiner*—Richard C. Pinkham
*Assistant Examiner*—T. Brown
*Attorney, Agent, or Firm*—Benjamin P. Reese, II; Charles J. Prescott

[57] ABSTRACT

A pool game set for use on a dining room table, kitchen table or another similar tabletop or the like. The pool game set comprises an essentially rectangular, bottomless frame, a plurality of lightweight, rigid balls, and a cue stick. The frame has a plurality of inwardly opening pockets and a plurality of elastic band holders which hold a plurality of elastic bands between adjacent pockets to function as bumpers. Each of the balls has a fibrous surface texture which simulates the surface texture of the felt top of a conventional pool table. The cue stick has a resilient vinyl or rubber tip with such a surface texture.

1 Claim, 9 Drawing Figures

POOL GAME SET

BACKGROUND OF THE INVENTION

This invention relates generally to a pool game set for use on a tabletop or the like, and particularly, to such a pool game set comprising an essentially rectangular, bottomless frame, a plurality of lightweight, rigid balls, each of said balls having a fibrous surface texture which simulates the surface texture of the felt top of a conventional pool table, and a cue stick having a resilient vinyl or rubber tip with such a fibrous surface texture.

Various pool game sets and the like for use on a tabletop or the like are provided by the prior art. Certain of such prior art pool game sets include a bottomless frame which is placed on the tabletop or the like to create a pool table. Typically, when such prior art pool game sets include a bottomless frame, smooth, lightweight, resilient balls are provided to prevent denting, marring, scratching and other damage to the tabletop or the like. Unfortunately, the combination of a smooth tabletop or the like and smooth, resilient balls does not simulate the play characteristics of a conventional pool table with conventional pool balls.

It is desirable to have a pool game set or the like for use on a tabletop or the like which includes a bottomless frame and simulates the play characteristics of a conventional pool table with conventional pool balls. And, of course, such a pool game set should be useable on a tabletop or the like without denting, marring, scratching and other damage. It is believed that these characteristics are best achievable in such a pool game set by providing a plurality of lightweight, rigid balls, each of which has a fibrous surface texture which simulates the surface texture of the felt top of a conventional pool table, and a cue stick having a resilient vinyl or rubber tip with such a fibrous surface texture. It is not believed that the prior art provides a pool game set having such balls and such a cue stick.

SUMMARY OF THE INVENTION

The present invention provides a pool game set comprising an essentially rectangular, bottomless frame, a plurality of lightweight, rigid balls, each of said balls having a fibrous surface texture which simulates the surface texture of the felt top of a conventional pool table, and a cue stick having a resilient vinyl or rubber tip with such a fibrous surface texture. The pool game set of the present invention is particularly suitable for use on a dining room table, a kitchen table or another similar tabletop or the like.

The bottomless frame of the pool game set comprises a plurality of connectable sections. Each of the sections comprises an inverted channel having integrally formed legs and an integrally formed connecting means on each of its ends. Pockets are provided in the channels which simulate the end and side pockets of a conventional pool table. Each of the legs is adjacent to one side of the mouth of one of the pockets and has an integrally formed, wedge-shaped, elastic band holder. A bumper is provided between each adjacent pair of pockets by stretching a continuous elastic band around the appropriate holders. Separate bumpers, each of which comprises a solid body having an elastic ring fitted in a circumferential groove and a suction cup attached to its bottom for removeably attaching the body to the tabletop or the like, are provided for playing bumper pool.

The lightweight, rigid balls are preferably hollow and formed from a high impact strength polystrene by a blow molding process. Each of the balls has a fibrous surface texture which simulates the surface texture of the felt top of a conventional pool table. The use of such balls on a smooth tabletop or the like simulates the play characteristics of a conventional pool table and conventional pool balls. Denting, marring, scratching and other damage to the tabletop or the like is prevented by the use of such balls and a cue stick having a resilient vinyl or rubber tip with the above described fibrous surface texture.

The elastic bands and elastic rings are positioned at a height above the centers of gravity of the balls and at an angle which imparts a top spin to the balls as they rebound after striking the elastic bands and elastic rings. The imparted top spin prevents the balls from bouncing and departing from the tabletop or the like. And, the fibrous surface texture of the balls slows the balls as they roll and prevents further rolling or sliding after the balls come to rest during play.

These and many other advantages, features and objects of the present invention will be apparent from the following brief description of the drawings, description of the preferred embodiment and claims, and the accompanying drawings.

DESCRIPTION OF THE PREFERRED EMBODIMENT

The preferred embodiment of the pool game set of the present invention is illustrated in FIGS. 1–9.

Figure 1:
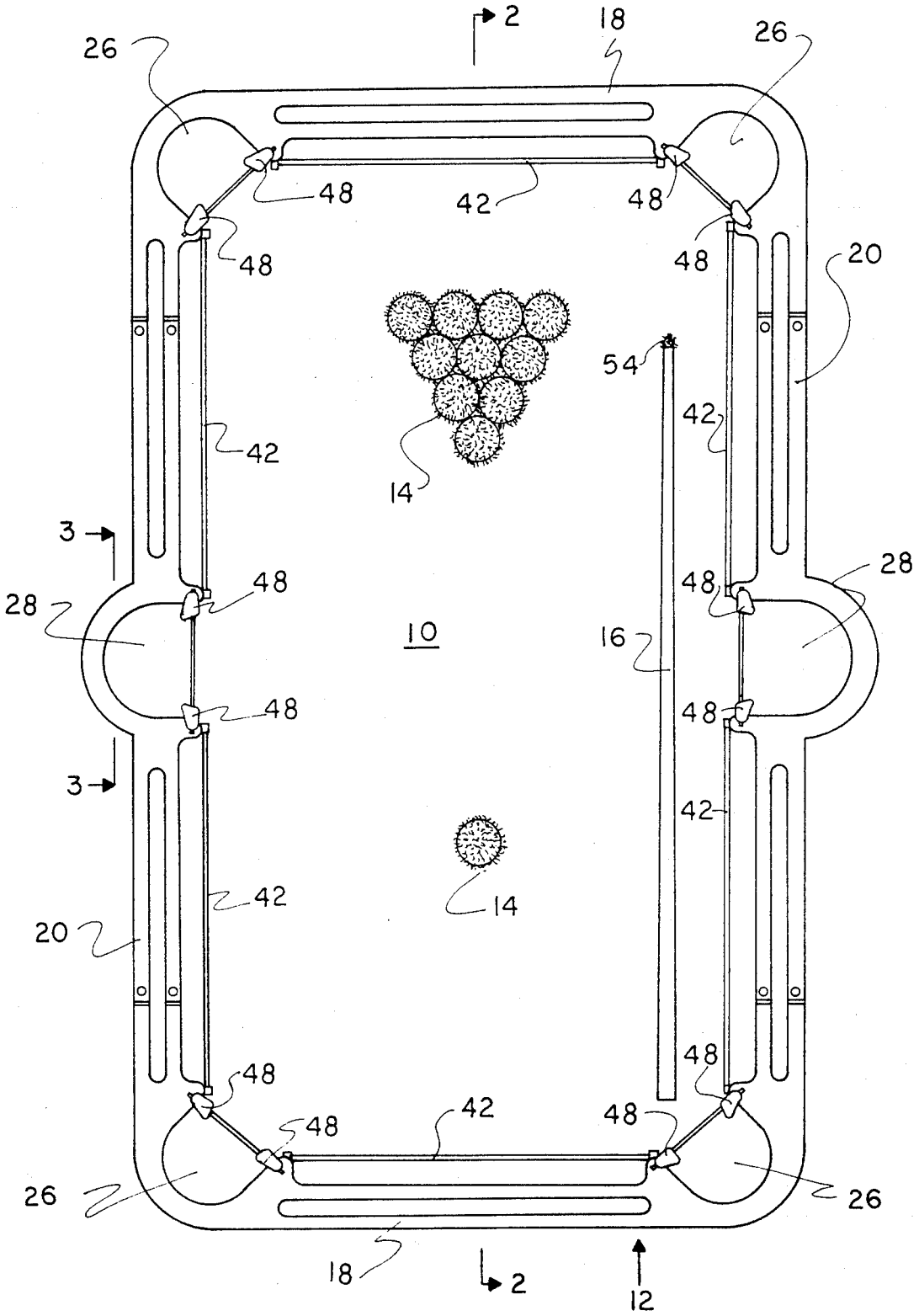
FIG. 1 is a top plan view of the pool game set of the present invention.

Referring initially to FIG. 1, the pool game set 10 comprises an essentially rectangular, bottomless frame 12 adapted for placement on a dining room table, a kitchen table or another similar tabletop or the like, a plurality of lightweight, rigid balls 14, and a cue stick 16. The frame 12 comprises a plurality of connectable sections, such as two identical end sections 18 and two identical side sections 20, which are preferably formed from a high impact strength polystrene by an injection molding process. Other rigid materials and forming processes are suitable for the frame 12, however.

Each of the end sections 18 and side sections 20 of the frame 12 comprises an inverted channel 22 having a plurality of integrally formed legs 24, four each for each of the end sections 18 and two each for each of the side sections 20. A pocket 26 is provided in each of the corners of the end sections 18. Each of the side sections 20 has a pocket 28 at its center. The corner pockets 26 and end pockets 28 are geometrically configured to simulate the pockets of a conventional pool table. When the end sections 18 and side sections 20 are connected, the corner pockets 26 and side pockets 28 open inward in the manner of the pockets of a conventional pool table.

Figure 4:
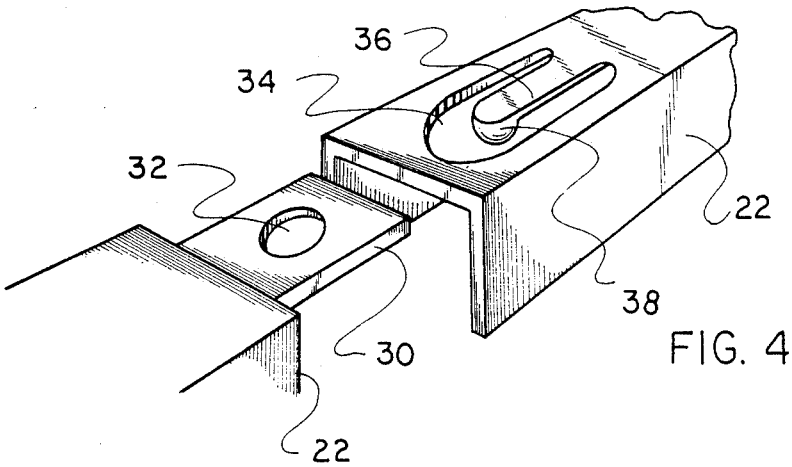
FIG. 4 is a detail perspective view illustrating one of the connecting means for the individual sections which comprise the bottomless frame of the pool set.
Figure 5:
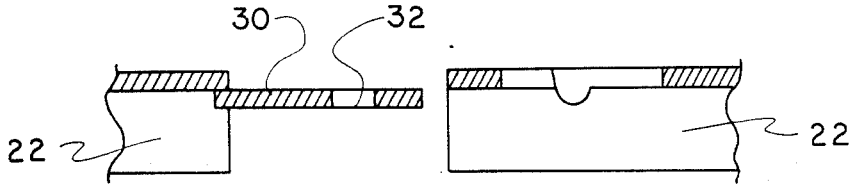
FIG. 5 is a detail sectional view of the connecting means illustrated in FIG. 4.
Figure 6:
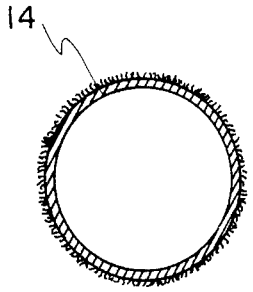
FIG. 6 is a cross sectional view of one of the lightweight, rigid balls of the pool game set.

Various connecting means are suitable for use with the end sections 18 and side sections 20 of the frame 12. Since no clips, bolts, screws or other separate connectors or fasteners are required, the integrally formed connecting means illustrated in FIGS. 4 and 5 is preferred. Referring now to FIGS. 4 and 5, the channel 22' on the left has a horizontal, plate-like tongue 30 adapted for insertion in, and withdrawal from, the channel 22'' on the right. A vertical hole 32 is provided through the tongue 30 of the channel 22'. The channel 22'' has a curved slot 34 which demarcates a cantilever spring 36 having a hemispherical locking element 38 extending downward from its free end. When the tongue 30 of the channel 22' is inserted in the channel 22'', the locking element 38 flexes upward until the vertical axis of the hole 32 and the vertical axis of the locking element 38 are aligned. Then, the cantilever spring 36 flexes downward, and, thereby, forces the locking element 38 into the hole 32.

Figure 2:
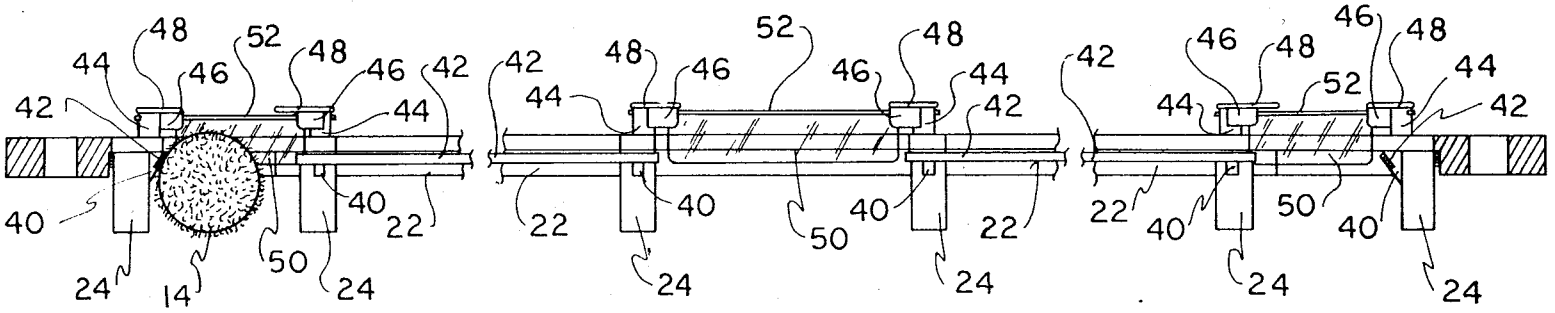
FIG. 2 is a fragmented sectional view of the bottomless frame of the pool game set taken along line 2—2 in FIG. 1.

Referring now to FIGS. 1 and 2, each of the legs 24 of the end sections 18 and side sections 20 of the frame 12 is positioned adjacent to one side of the mouth of one of the end pockets 26 or side pockets 28. A wedge-shaped, elastic band holder 40 is integrally formed with the upper end of each of the legs 24. When the end sections 18 and side sections 20 are connected, the holders 40 face inward and downward. A bumper is provided between each pair of adjacent end pockets 26 and each end pocket 26 and the side pocket 28 adjacent thereto by stretching a continuous elastic band 42 of natural or synthetic rubber around the applicable pair of holders 40. The holders 40 position the elastic bands 42 parallel to and away from the recessed sides of the channels 22 of the end sections 18 and side sections 20 at a height which is slightly above the center of gravity of the balls 14 and at an angle of fifty-six degrees from the tabletop or the like on which the frame 12 is placed.

Figure 3:
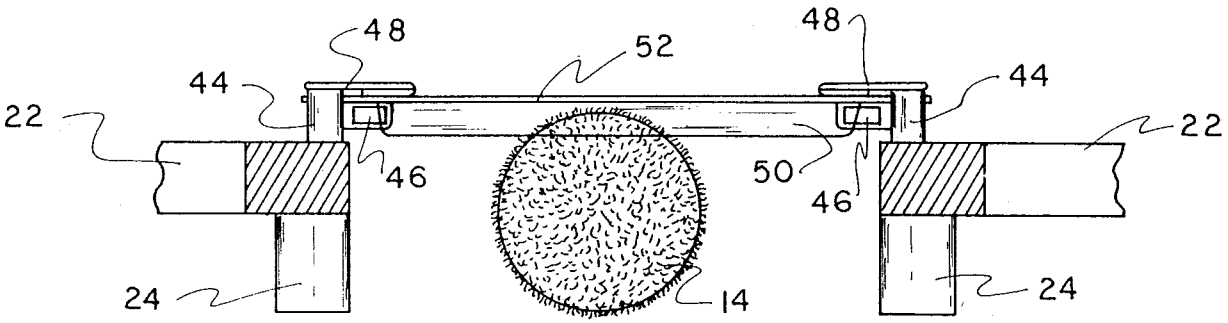
FIG. 3 is a detail sectional view of one of the pocket openings of the bottomless frame and a lightweight, rigid ball taken along line 3—3 in FIG. 1.

Referring now to FIGS. 1, 2 and 3, the channels 22 of the end sections 18 and side sections 20 of the frame 12 have a plurality of integrally formed posts 44 which extend upward from their respective top surfaces. Each of the posts 44 is positioned adjacent to one side of the mouth of one of the end pockets 26 or side pockets 28. An integrally formed, plate-like, vertical stop 46 and an integrally formed, plate-like, horizontal stop 48 extend from the upper end of each of the posts 44 for a short distance across the mouth of the adjacent end pocket 26 or side pocket 28. A plate-like gate 50 having an integrally formed rod 52 is suspended between each pair of posts 44 adjacent to the mouth of an end pocket 26 or a side pocket 28 by rotatably mounting the opposite ends of the rod 52 in horizontally aligned holes through the upper ends of the posts 44 which comprise the pair. The gates 50 and integrally formed rods 52 are preferably formed from a transparent or translucent high impact strength polystrene by an injection molding process. However, other rigid materials and forming processes are suitable for the gates 50 and integrally formed rods 52. Also, if desired, the gates 50 and rods 52 can be separately formed and joined by conventional processes.

Referring now to FIGS. 1, 2, 3 and 6, each of the balls 14 has a fibrous surface texture which simulates the surface texture of the felt top of a conventional pool table. The balls 14 are preferably hollow and formed from a high impact strength polystrene by a blow molding process. With that material and process, each of the resulting lightweight, hollow balls 14 has a uniform wall thickness to assure that it rolls properly during play. After forming, each of the balls 14 is flocked to create the above described fibrous surface texture. Other materials and processes are suitable for forming the balls 14 with the above described fibrous surface texture. For example, the balls 14 can be formed with a fibrous surface texture in a one step process by blow molding polyethylene or polypropylene in a vapor hone mold. Alternatively, polyethylene or polypropylene can be blow molded in a conventional mold and the resulting smooth, lightweight, hollow balls 14 can be cryogenically blasted to create the above described fibrous surface texture.

The fibrous surface texture of the balls 14 essentially eliminates denting, marring, scratching and other damage to the tabletop or the like on which the frame 12 and balls 14 are placed for playing a pool game. Additionally, the fibrous surface texture slows the rolling movement of the balls 14 and essentially eliminates rolling or sliding after the balls 14 have come to rest on the tabletop or the like during a pool game. This is particularly important since the typical tabletop or the like on which the pool game set 10 is used is a dining room table or kitchen table having a smooth but unlevel surface. Finally, the combination of the fibrous surface texture of the balls 14 and the smooth tabletop or the like on which the frame 12 and balls 14 are placed simulates the play characteristics of a conventional pool table having a felt top and conventional pool balls having smooth surfaces.

The cue stick 16 which is included in the pool game set 10 can be of either the conventional type or the spring-actuated type. If of the conventional type, the cue stick 16 is preferably formed from a high impact strength polystrene by an injection molding process. However, other rigid materials and forming processes are suitable. Examples of suitable spring-actuated cue sticks 16 are disclosed in U.S. Pat. Nos. 497,929 and 3,711,093. Whether of the conventional type or the spring-actuated type, the cue stick 16 is provided with a resilient vinyl or rubber tip 54 having a fibrous surface texture which is essentially identical to the fibrous surface texture of the balls 14 to prevent denting, marring, scratching and other damage to the tabletop or the like during the pool game.

Figure 7:
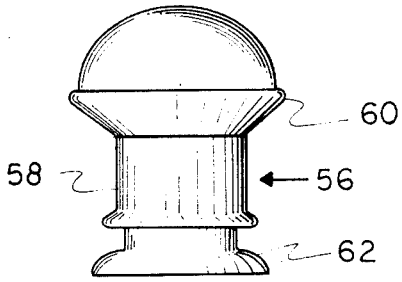
FIG. 7 is an elevational view of one of a plurality of identical bumpers for use with the pool game set when playing bumper pool.
Figure 8:
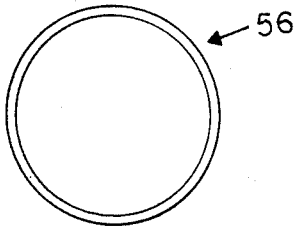
FIG. 8 is a top plan view of the bumper illustrated in FIG. 7.
Figure 9:
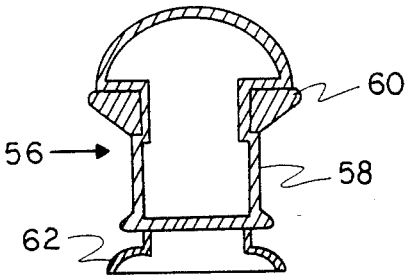
FIG. 9 is an elevational sectional view of the bumper illustrated in FIG. 7.

Finally FIGS. 7, 8, and 9 illustrate one of a plurality of identical bumpers 56 for use with the pool game set 10 when playing bumper pool or the like. Each of the bumpers 54 comprises a rigid body 58, a solid, wedge-shaped, elastic ring 60, and a suction cup 62. Preferably, the body 58 is formed from a high impact strength polystrene by a blow molding process. However, other rigid materials and forming processes are suitable. The ring 60 and suction cup 62 are preferably formed from a soft natural or synthetic rubber material. The ring 60 is fitted in a circumferential groove in the body 58 and positioned at the same height and angle as the elastic bands 42. The suction cup 62 is fixedly attached to the bottom of the body 58 to facilitate attachment of the body 58 to the tabletop or the like on which the pool game will be played.

Having described the structure of the pool game set 10, its use will now be described. First, the end sections 18 and side sections 20 which comprise the bottomless frame 12 are connected and the elastic bands 42 are stretched around the holders 40 as illustrated in FIG. 1. Then, the frame 12 is placed on the tabletop or the like which is available for playing a pool game. If the players desire to play bumper pool or the like, the bumpers 56 are placed on the tabletop or the like at the appropriate locations. Next, the balls 14 are placed on the tabletop or the like and racked or otherwise positioned at the proper locations for the game which is to be played. In that regard, while no markings are shown on the balls 14 as illustrated in FIG. 1, one of the balls 14 is typically a white cue ball and the remainder of the balls 14 are typically solid colored and striped, numbered balls simulating conventional pool balls.

During the pool game, the cue stick 16 is used in the conventional manner to strike the cue ball 14. The cue ball 14 rolls until it strikes an elastic band 42, an elastic ring 60, a gate 50 or one of the numbered balls 14. If the cue ball 14 strikes one of the numbered balls 14, energy is transferred to the numbered ball 14 and it begins to roll. When any ball 14 strikes one of the elastic bands 42 as it rolls, the struck elastic band 42 first flexes and then returns to its unflexed position to rebound the ball 14. Because of the height and angle of the elastic band 42, a top spin is imparted to the ball 14 as it rebounds. The top spin prevents the ball 14 from bouncing and departing from the tabletop or the like as it is rebounded. A similar action occurs if a ball 14 strikes the elastic ring 60 on one of the bumpers 56. If any ball 14 strikes one of the gates 50 as it rolls, the struck gate 50 swings upward until its movement is stopped by the horizontal stop 48 and allows the ball 14 to roll into the applicable end pocket 26 or side pocket 28. After the ball 14 has rolled into the applicable end pocket 26 or side pocket 28, the gate 50 swings downward until its movement is stopped by the vertical stop 46 and prevents the ball 14 from rolling out of the applicable end pocket 26 or side pocket 28.

While the present invention has been disclosed in connection with the preferred embodiment, it should be understood that there may be other embodiments which fall within the scope and spirit of the invention as defined by the claims.

We claim:

1. A pool game set for use on a tabletop or the like, comprising:

a rigid, bottomless frame having a plurality of inwardly opening pockets, said frame comprising a plurality of connectable sections; each of said sections comprising an inverted channel having an integrally formed, horizontal, plate-like tongue with a vertical hole therethrough on one of its ends and a curved slot in its upper surface which demarcates a cantilever spring on the other of its ends, said cantilever spring having a hemispherical locking element extending downward from its free end, said channels being connectable by inserting said tongue on one end of one of said channels in said end of another of said channels having said cantilever spring such that said cantilever spring first flexes upward until the vertical axis of said locking element is aligned with the vertical axis of said hole and then flexes downward to force said locking element into said hole;

a plurality of elastic band holders, each of said holders being integrally formed with said frame at a location adjacent to one side of the mouth of one of said pockets;

a plurality of elastic bands, each of said bands being stretched between a pair of said holders to function as a bumper between a pair of said pockets;

a plurality of lightweight, rigid balls, each of said balls having a fibrous surface texture which simulates the felt top of a conventional pool table; and a cue stick.

* * * * *